US006416134B1

(12) United States Patent
Share et al.

(10) Patent No.: US 6,416,134 B1
(45) Date of Patent: Jul. 9, 2002

(54) UNDERGROUND AUGER SYSTEM

(75) Inventors: Douglas J. Share, Fresno; Troy Blackford, Zanesville; Ronald C. Deeter, Malvern, all of OH (US)

(73) Assignee: Brydet Development Corp., Conshocton, OH (US)

( * ) Notice: Subject to any disclaimer, the term of this patent is extended or adjusted under 35 U.S.C. 154(b) by 0 days.

(21) Appl. No.: 09/662,292

(22) Filed: Sep. 14, 2000

(51) Int. Cl.[7] ..... E21B 3/02; E21B 19/14

(52) U.S. Cl. ..... 299/55; 299/68; 299/87.1; 175/52; 175/85

(58) Field of Search ..... 299/55, 56, 68, 299/87.1; 175/51, 52, 85, 323

(56) References Cited

U.S. PATENT DOCUMENTS

| | | | | |
|---|---|---|---|---|
| 2,846,093 | A | | 8/1958 | Densmore |
| 2,948,520 | A | * | 8/1960 | Densmore |
| 2,951,693 | A | * | 9/1960 | Carothers |
| 3,091,439 | A | * | 5/1963 | Adams et al. |
| 3,278,236 | A | * | 10/1966 | Adams et al. |
| 3,281,187 | A | | 10/1966 | Adams et al. |
| 3,291,534 | A | * | 12/1966 | Adams et al. |
| 3,682,261 | A | | 8/1972 | Bird |
| 3,698,768 | A | | 10/1972 | Delli-Gatti |
| 3,746,110 | A | * | 7/1973 | Young et al. |
| 3,897,976 | A | * | 8/1975 | Gallis |
| 3,918,536 | A | * | 11/1975 | Deeter et al. |
| 3,967,909 | A | * | 7/1976 | Deeter et al. |
| 3,972,375 | A | * | 8/1976 | Deeter et al. |
| 3,983,949 | A | * | 10/1976 | Pozniko |
| 4,264,106 | A | | 4/1981 | Deeter et al. |
| 4,732,224 | A | * | 3/1988 | Deeter et al. |
| 5,695,016 | A | | 12/1997 | Deeter et al. |

* cited by examiner

*Primary Examiner*—David Bagnell
*Assistant Examiner*—Daniel P Stephenson
(74) *Attorney, Agent, or Firm*—Frederic E. Naragon

(57) ABSTRACT

An underground augering system comprising a drill unit adjustably connected to a retrieving unit by interchangeable and adjustable connectors to provide for simultaneous drilling of one hole and the removal of auger flights from a previous drilled hole, a crowd mechanism within each unit to move the drill and retrieval carriages to and from holes, a transfer arm to move auger flights to and from a staging rack within the retrieval unit and belly pan within the drill unit, and belly pan within the retrieval unit, a mechanism and staging rack for the storage of auger flights, and a delatch mechanism within the drill unit and retrieval unit to disengage the latch lever in an auger flight for removal of the auger flight from a string of auger flights.

10 Claims, 16 Drawing Sheets

UNDERGROUND AUGER SYSTEM

BACKGROUND OF THE INVENTION AND SUMMARY OF THE INVENTION

The present invention relates generally to a system for mining coal in underground mines wherein a drilling unit bores horizontal holes into a coal seam and a retrieval unit extracts auger flights from a previously drilled hole simultaneously and in conjunction with the drilling unit.

In the prior art and in the present invention auger mining machines of this type comprise an auger embodying a cutting head suitable to the thickness of the coal seam connected to and rotatably driven by a string of end connected, helixally veined auger sections driven from the machine by being rotated and urged longitudinally of the auger. The cutting head penetrates the coal seam and the mine coal is transported rearwardly from the cutting head along the auger string by the veins of the auger sections out of the hole cut by the cutting head to a conveyor which carries the coal away from the machine. As the cutting head is caused to penetrate into the hole, it is necessary to introduce auger sections into the string until the desired length of the auger string is reached to achieve the desired depth of the hole. After the cutting head has penetrated to the desired depth of the hole it must be withdrawn by removing auger sections until the cutting head is out of the hole. The machine as a whole is then moved laterally to another position where its auger can drill another hole generally parallel to the previously drilled hole. Heretofore the prior art has disclosed patents for various augers and systems for the mining of coal. Some of the patents of the prior art are listed as follows:

U.S. Pat. No. 3,682,261 Michael J. Bird, Aug. 8, 1972

U.S. Pat. No. 2,846,093 Neil W. Densmore, Aug. 5, 1958

U.S. Pat. No. 3,281,187 G. L. Adams, et al., Oct. 27, 1966

U.S. Pat. No. 5,695,016 Ronald C. Deeter, et al., Dec. 9, 1997

U.S. Pat. No. 3,698,768 John L. Delli-Gatti, Oct. 17, 1972

U.S. Pat. No. 4,264,106 Ronald C. Deeter, et al., Apr. 28, 1981

Typically, in the underground mining of coal a roadway is created in the mine of predetermined limited height and width and thus, the size and height of the augering apparatus becomes critical and the retrieval and storage of auger flights presents a storage problem. Heretofore, in augering machines for mining coal in underground mines a series of relatively deep parallel horizontal holes are drilled in the coal seam and when the drilling of one hole is completed the augering machine is moved over the mine floor to a next adjacent position for drilling an adjacent parallel hole. The auger drill string is detached from the chuck of the boring machine prior to the shifting of the machine to its new drilling position and the series of auger drill flights are stored in the completed hole or on the floor of the roadway until needed for use in the drilling of the next adjacent hole. The auger flights are transferred a section at a time for connection to the drill string during drilling of the adjacent hole. It has become customary practice to roll the heavy auger sections over the rough bottom or floor of the mine and to lift manually and rotate the auger sections to bring them in proper alignment with the drill chuck to enable attachment thereof to the drill string as the adjacent hole deepens. In some instances a string of auger flights is stored in the previous drilled hole and requires the use of a separate apparatus to retrieve and transfer the auger flights to the auger machine for use in drilling the next adjacent hole. Such a transfer mechanism for auger drills is disclosed in U.S. Pat. No. 2,846,093 issued to Neil W. Densmore on Aug. 5, 1958.

One object of the present invention is to provide a new and improved underground auger system comprising a drilling unit and a retrieval unit which are adjustably connected and provide for the continuous drilling of holes and simultaneous retrieval of auger flights from a previous drilled hole, thus increasing efficiency in the mining of the coal and more efficient storage and transfer of auger flights to the drilling unit. In addition, the drilling unit and retrieval unit are coupled in front and back preferably with dog-bone type connectors which assures consistent pillar widths (the center to center distance of the auger holes) and closer coupling distances and also reduces the stress induced into each unit's frame in the event of uneven alignment. The dog-bone connectors are interchangeable to allow adjustments to pillar widths and assure the drive chains of the drill unit and retrieval unit are parallel during operation.

U.S. Pat. No. 3,682,261 issued to Michael J. Bird on Aug. 8, 1972, discloses a tunnel boring machine with a carriage which slides along a track and the carriage includes a spindle for attachment to a boring auger and a power supply which drives the spindle and also drives an hydraulic ram which moves the carriage along the track. A winch assembly is also provided in conjunction with the spindle for retracting auger sections from the bored tunnel without moving the carriage. The invention does not provide or teach of an underground auger system comprising a drilling unit and retrieving unit which are adjustably connected and work simultaneously with each other.

Further, the present invention provides a crowd mechanism within the drill unit for movement of the carriage and results in crowding forward in connect ion with the rotation of the cutting head and gives the cutting head the ability to dig the bits into the coal seam and cut. The crowd mechanism comprises a chain and sprocket system coupled to hydraulic cylinders which gives a mechanical disadvantage, however, it allows the carriage to move twice the distance of the cylinder stroke. Guide bars keep the sprocket from wandering off of a track and reduces wear on the cylinder seals. Two hydraulic cylinders are used for moving the carriage in each direction (four per unit) and thread adjustments are provided under the carriage to allow adjustment for cylinder differences and chain wear. A second crowd mechanism is provided within the retrieval unit and comprises the same component parts and provides for the movement of the carriage forward and backward and with the rotation of the drive unit gives the string of auger flights the ability to rotate out of the drilled hole. Prior art does not teach or disclose crowd mechanisms with respect to drilling units or retrieving units.

U.S. Pat. No. 3,698,768 issued to John L. Delli-Gatti on Oct. 17, 1972, provides an augering machine which includes an auger string composed of a plurality of auger flights connected to each other and at the rearward of the string a rotary drive means. The connection of the auger flights is by means of a pin and socket joint and includes a locking means and an unlocking member. Typically, in the industry auger flights are provided with a male and female end with the male end adapted to fit the female end of another auger flight and a spring-loaded latch pin is provided to secure two auger flights together and allowing the removal from the drilled hole without coming apart. In removing auger flights from the hole it is necessary to disconnect each auger flight from the string of auger flights for storage and transferring the auger flights to the drilling unit. The present invention provides a front delatch mechanism disposed within the drill unit and retrieval unit which comprises a hydraulic cylinder, bar linkage, and a spring-loaded latch actuator bar and provides a new and improved means of lifting the latch pin on the auger flight to provide for disconnecting of each auger flight from the string upon their removal from the drilled hole. The prior art does not teach or disclose of such a front delatch mechanism.

The present invention further provides for a transfer arm located within the retrieval unit to move auger flights from a belly pan in the retrieval unit to a belly pan in the drill unit during operation and it also is used to move auger flights to and from a staging rack in the retrieval unit to the belly pans of the drill and retrieval units. The transfer arm comprises a telescoping arm attached pivotally to the retrieval unit at one end and with a fork at the other end to cradle the auger flights when lifting and moving the flights. Hydraulic cylinders are provided to raise and lower the transfer arm and to extend and retract the arm. A transfer arm is not disclosed or taught in any prior art.

Another object of the present invention is to provide a staging rack area disposed within the retrieval unit to allow for the loading, unloading, and storage of auger flights within the retrieval unit and to allow the auger flights to be moved to and from the belly pan in the retrieval unit and further to allow the auger flights to be ready and available to be picked up by the transfer arm. In operation the auger flights may be moved to and from the retrieval unit and the drilling unit by the transfer arm and may be moved to and from the belly pan of the retrieval unit to the staging rack allowing for great flexibility in locating the auger flights for each stage of operation. A drive cross shaft with sprockets at each end driven by a power source is provided together with a second set of sprockets, shaft, and transfer chains with rollers to move the auger flights to and from the storage area and the belly pan within the retrieval unit. The transfer chains are synchronized and chain attachments, side guides, adjustment means, and stops are provided to prevent the auger flights from rolling and twisting during movement and to insure proper alignment of the auger flights.

The present invention further provides leveling jacks and skids in the drill unit and the retrieval unit to facilitate moving the machine and setting the angle for extracting flights from previously drilled holes. Roof jacks are also provided with each unit to work in conjunction with the leveling jacks and skids to wedge the units between the roof and floor of the mine roadway providing stability during extracting and drilling operations.

Prior art discloses and teaches of various auger mining machines and retrieval and storage apparatus for auger flights. U.S. Pat. No. 3,281,187 issued to George L. Adams, et al. on Oct. 25, 1966, discloses and teaches of a dual augering mining machine with dual auger storage racks but does not provide or teach of an underground auger system such as the present invention with a drill unit and a retrieval unit which are adjustably connected and provide for the simultaneous drilling and removal of auger flights or of a transfer arm mechanism, staging rack, crowd mechanism and delatch mechanism as are provided in the present invention. Further U.S. Pat. No. 4,264,106 issued on Apr. 28, 1981, to Ronald C. Deeter, one of the inventors of the present invention, discloses an augering machine which embodies jacks and skids which permit ready maneuverability of the machine and a cross conveyor for conducting away mined material from the auger string which are also provided in the present invention. However, the invention does not provide or teach of an underground auger system comprising a drill unit adjustably connected with a retrieval unit, crowd mechanism, staging rack, transfer arm mechanism, or delatch mechanism as are provided in the present invention.

BRIEF DESCRIPTION OF THE DRAWINGS

For a better understanding of the invention reference should be made to the accompanying drawings wherein.

DETAILED DESCRIPTION OF THE DRAWINGS

Figure 1:
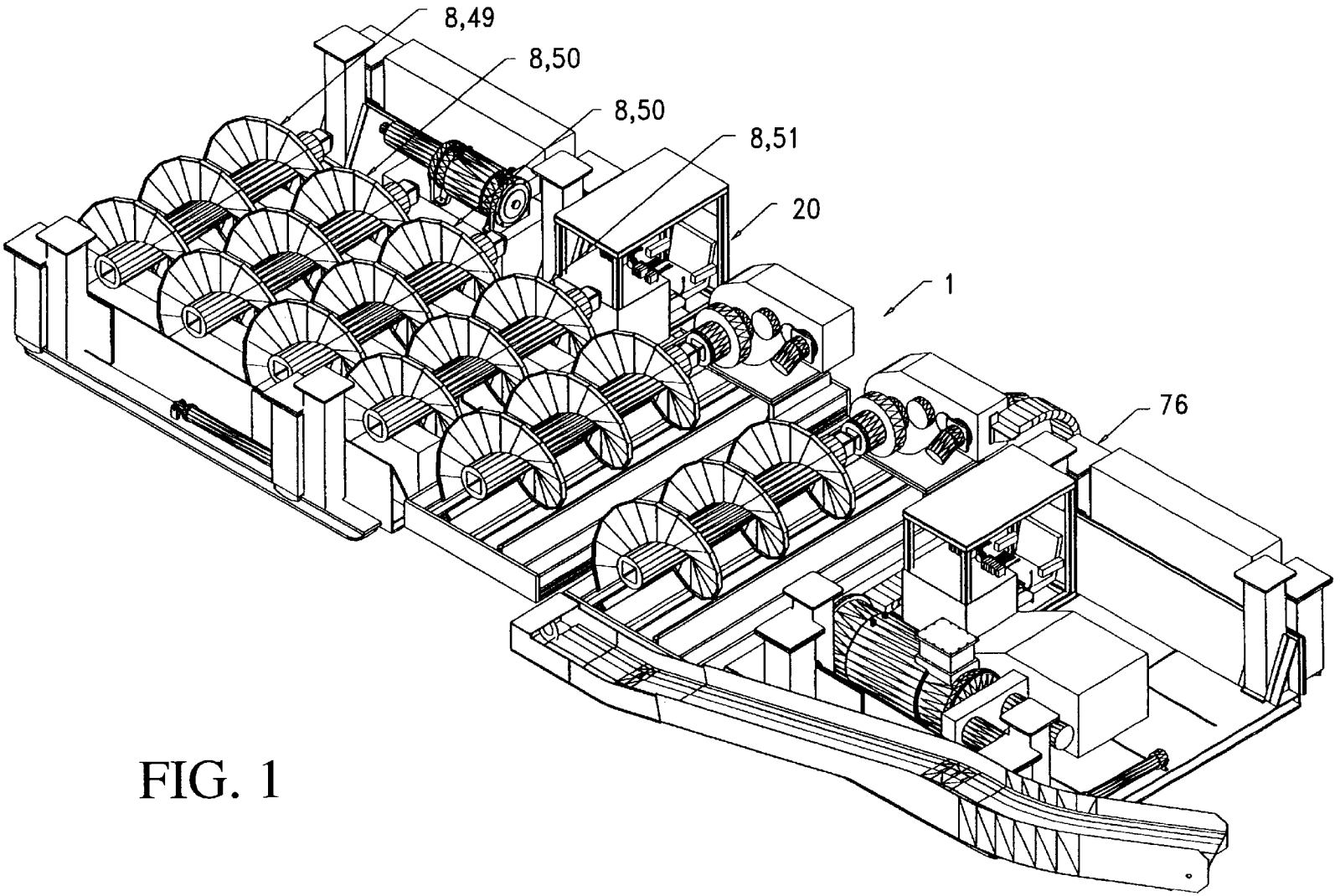
FIG. 1 is a perspective view of the present invention.

Reference is now made to the drawings wherein the present invention is illustrated in detail and wherein similar components bear the same reference numeral throughout the several views.

FIG. 1 is a perspective view of the present invention 1 and illustrates a retrieval unit 20, drill unit 76, the retrieval unit staging rack loading area 49, the retrieval unit staging rack storage area 50, the retrieval unit staging rack staging area 51, and auger flights 8 in position on the present invention 1.

Figure 2:
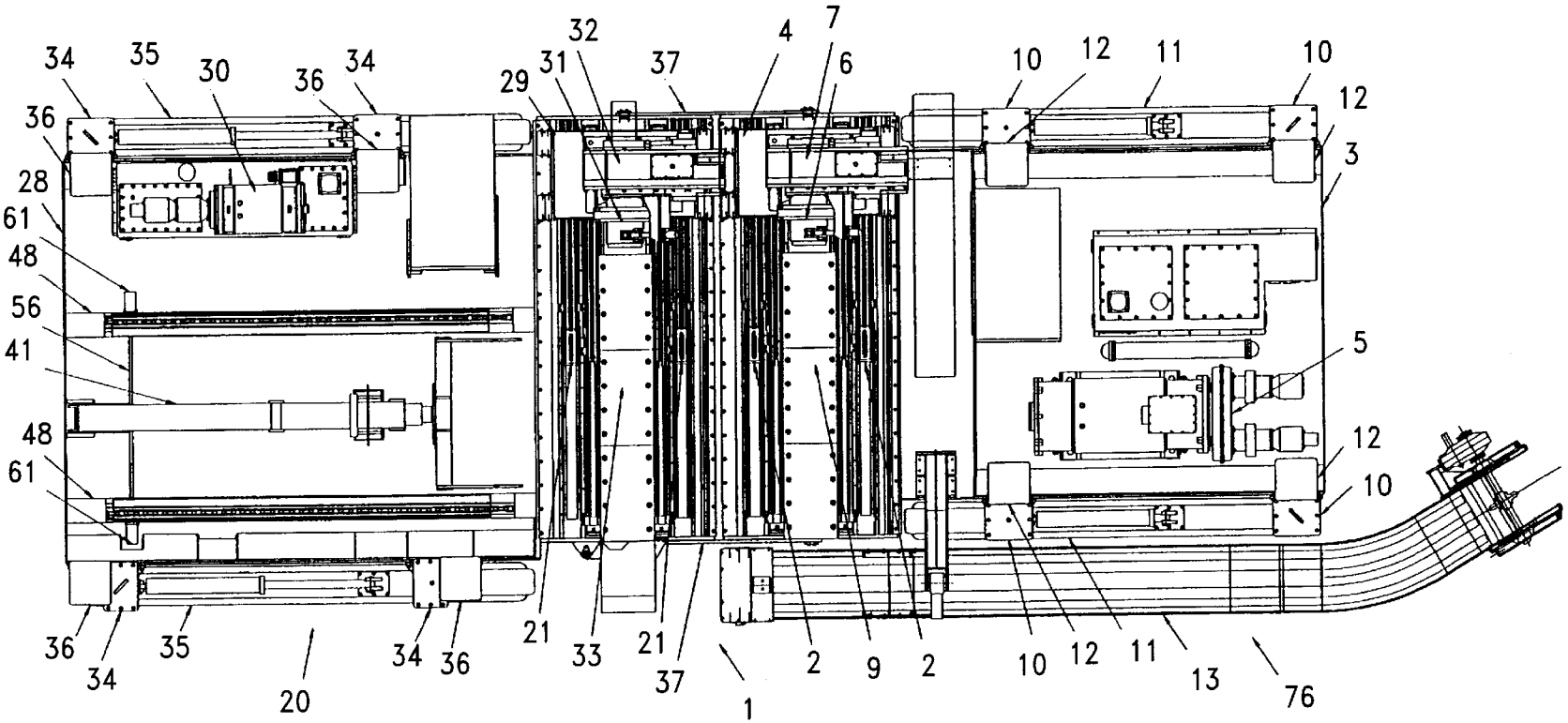
FIG. 2 is a plan view of the drill unit and retrieval unit of the present invention.

FIG. 2 is a plan view of the drill unit 76 and retrieval unit 20 and illustrates the drill unit crowd mechanism 2, drill unit frame 3, drill unit carriage 4, drill unit propulsion unit 5, drill unit drive chuck 6, drill unit rotating means 7, drill unit belly pan 9, drill unit leveling jack 10, drill unit skid 11, drill unit roofjack 12, drill unit conveyor 13, and interchangeable connecting link 37. The retrieval unit 20, the retrieval unit crowd mechanism 21, the retrieval unit frame 28, the retrieval unit carriage 29, the retrieval unit propulsion unit 30, the retrieval unit drive chuck 31, the retrieval unit rotating means 32, the retrieval unit belly pan 33, the retrieval unit leveling jack 34, the retrieval unit skid 35, the retrieval unit roofjack 36, transfer arm mechanism 41, retrieval unit staging rack 48, drive cross shaft 56, and retrieval unit staging rack power source 61 are further illustrated.

Figure 3:
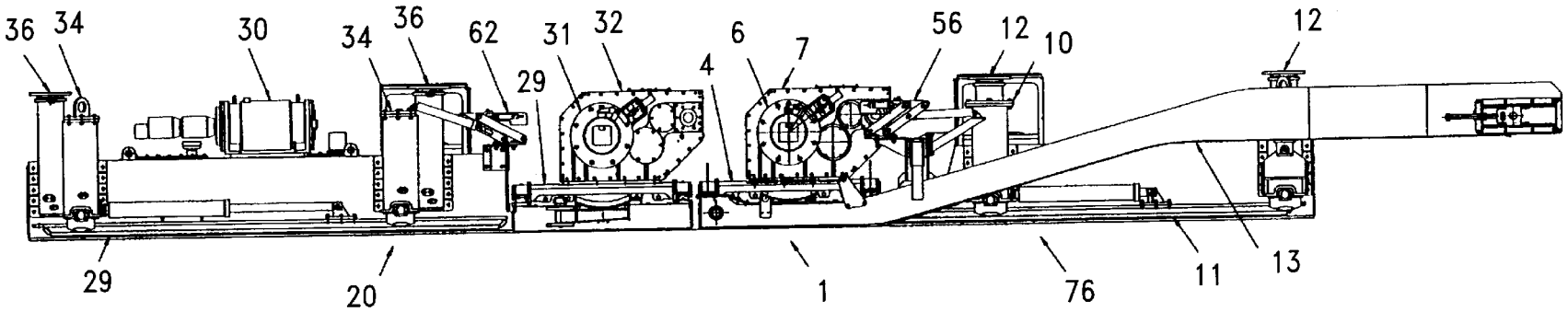
FIG. 3 is an elevation view of the drill unit and retrieval unit of the present invention.

FIG. 3 is an elevation view of drill unit 76 and retrieval unit 20 of the present invention 1 and further illustrates a drill unit carriage 4, drill unit drive chuck 6, drill unit rotating means 7, drill unit leveling jack 10, drill unit skid 11, drill unit roofjack 12, drill unit conveyor 13, and drive cross shaft 56. Retrieval unit carriage 29, retrieval unit propulsion unit 30, retrieval unit drive chuck 31, retrieval unit rotating means 32, retrieval unit leveling jack 34, retrieval unit roof jack 36, and delatch mechanism 62 are further illustrated.

Figure 4:
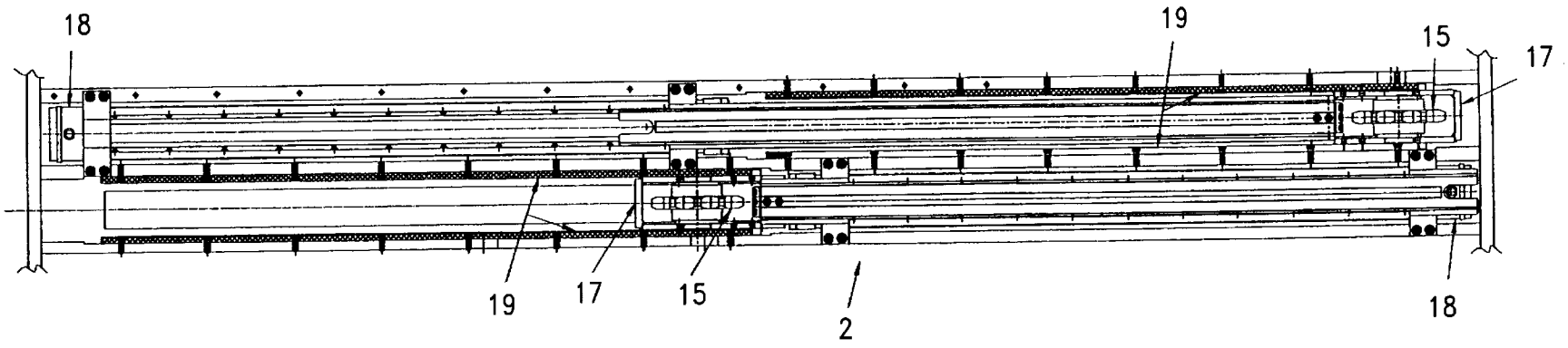
FIG. 4 is a plan view of the drill unit crowd mechanism of the present invention.

FIG. 4 is a plan view of the drill unit crowd mechanism 2 and further illustrates drill unit crowd mechanism sprocket 15, drill unit crowd mechanism sprocket box 17, drill unit crowd mechanism cylinder 18 and drill unit crowd mechanism guide bar 19.

Figure 5:
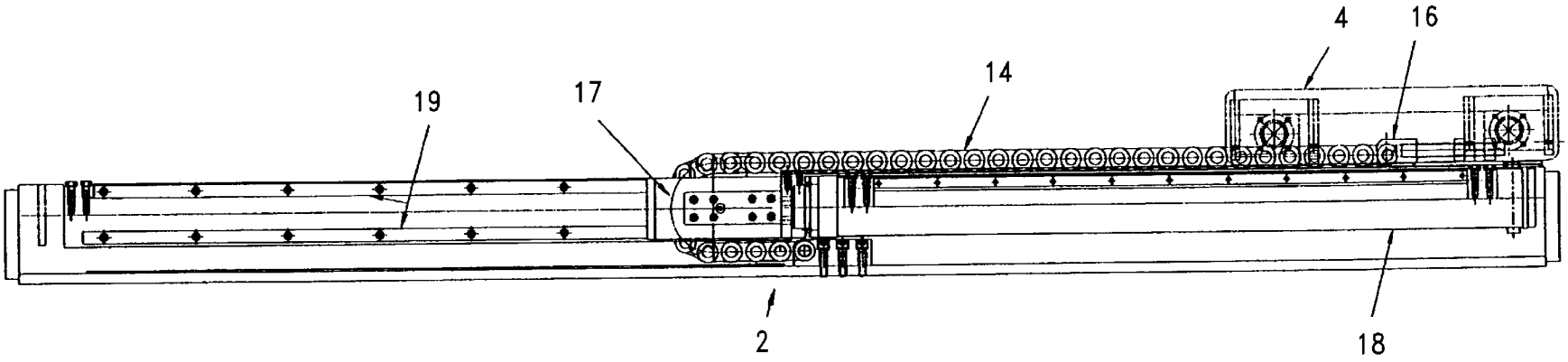
FIG. 5 is an elevation view of the drill unit crowd mechanism of the present invention.

FIG. 5 is an elevation view of the drill unit crowd mechanism 2 and further illustrates drill unit carriage 4, drill unit crowd mechanism chain 14, drill unit thread chain adjuster 16, drill unit crowd mechanism sprocket box 17, drill unit crowd mechanism cylinder 18, drill unit crowd mechanism guide bar 19.

Figure 6:
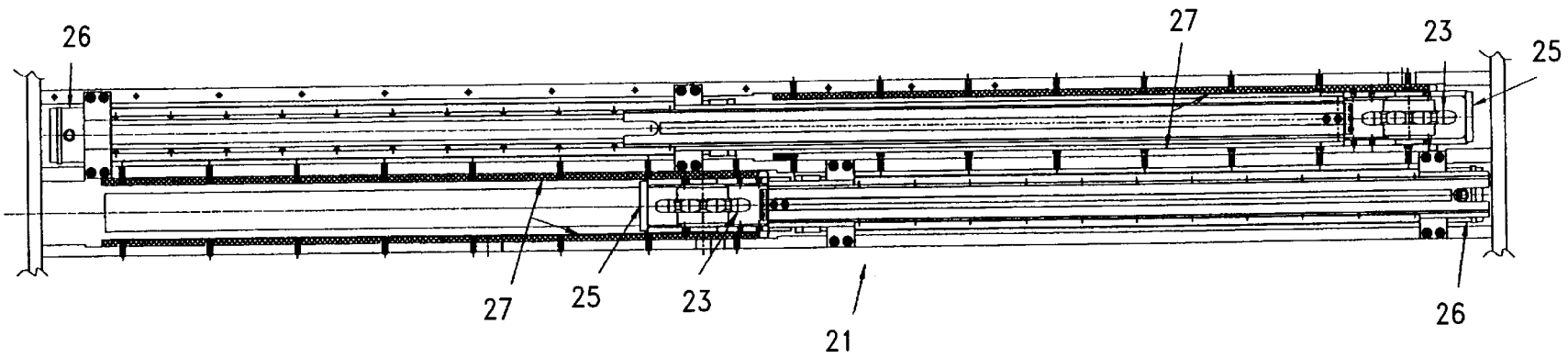
FIG. 6 is a plan view of the retrieval unit crowd mechanism of the present invention.

FIG. 6 is a plan view of the retrieval unit crowd mechanism 21 and further illustrates retrieval unit crowd mechanism sprocket 23, retrieval unit crowd mechanism sprocket box 25, retrieval unit crowd mechanism cylinder 26, and retrieval unit crowd mechanism guide bar 27.

Figure 7:
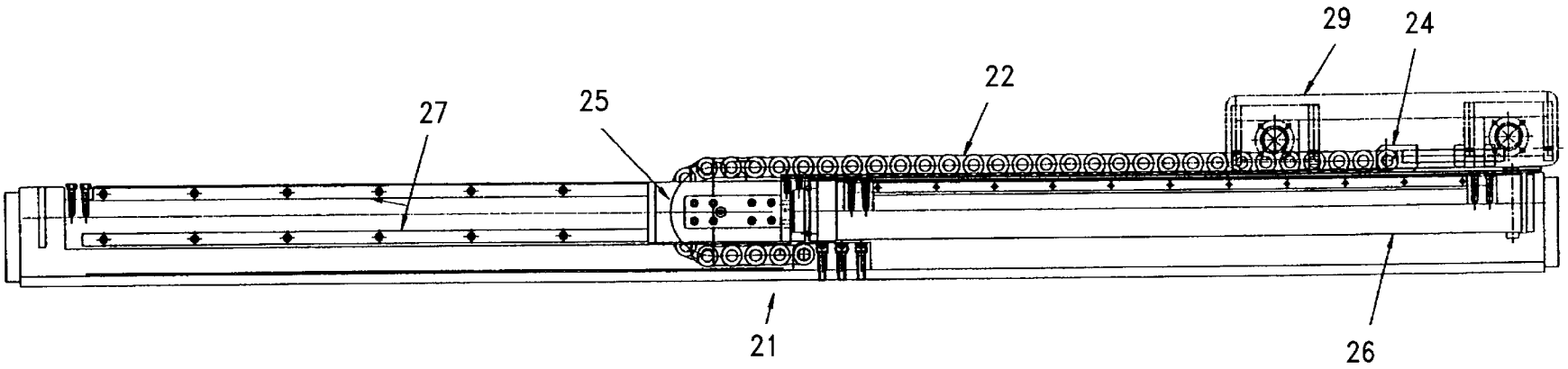
FIG. 7 is an elevation view of the retrieval unit crowd mechanism of the present invention.

FIG. 7 is an elevation view of the retrieval unit crowd mechanism 21 and further illustrates retrieval unit crowd mechanism chain 22, retrieval unit thread chain adjuster 24, retrieval unit crowd mechanism sprocket box 25, retrieval unit crowd mechanism cylinder 26, retrieval unit crowd mechanism guide bar 27, and retrieval unit carriage 29.

Figure 8:
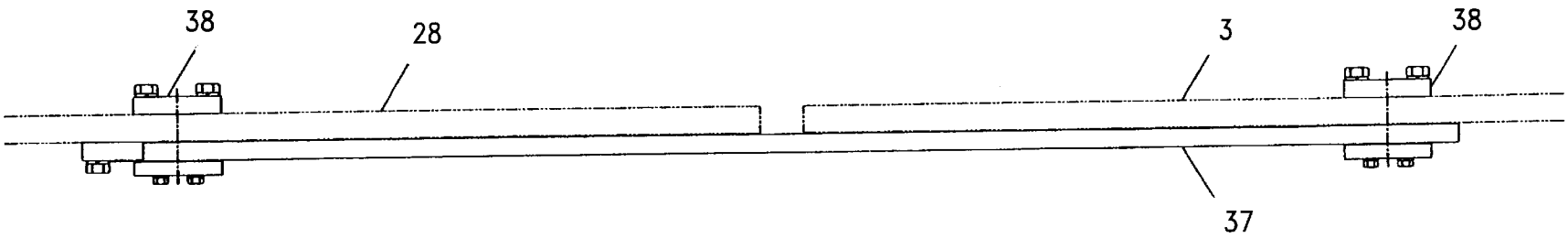
FIG. 8 is a plan view of the interchangeable connecting link of the present invention.

FIG. 8 is a plan view of the interchangeable connecting link 37 and further illustrates drill unit frame 3, retrieval unit frame 28, and connecting link pin 38.

Figure 9:
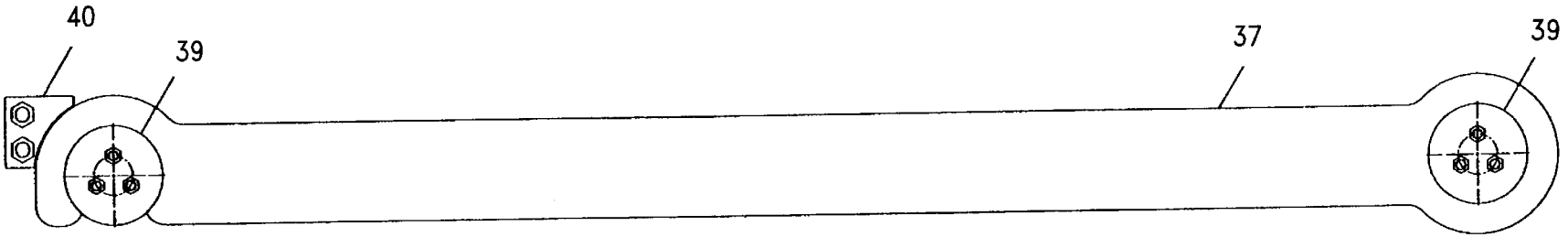
FIG. 9 is an elevation view of the interchangeable connecting link of the present invention.

FIG. 9 is an elevation view of the interchangeable connecting link 37 and further illustrates the connecting link cap 39, connecting link latch 40.

Figure 10:
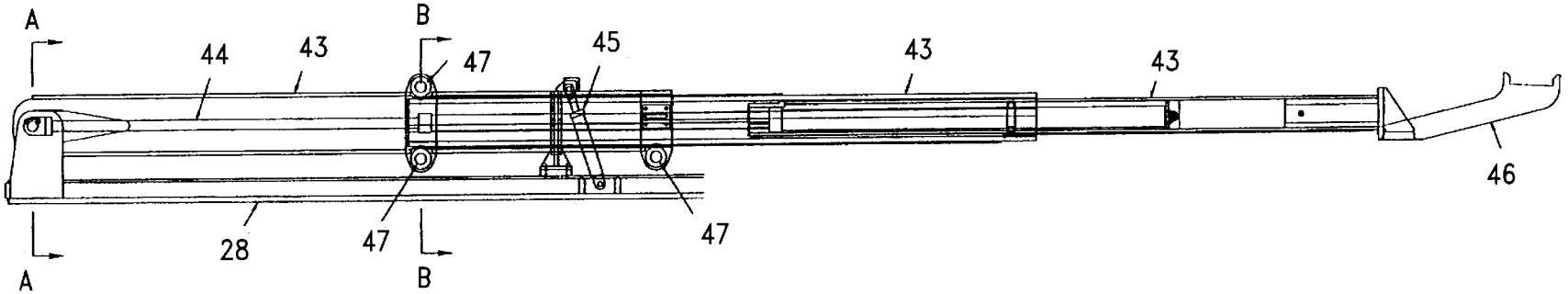
FIG. 10 is an elevation view of the transfer arm mechanism of the present invention.

FIG. 10 is an elevation view of the transfer arm mechanism 41 and illustrates the retrieval unit frame 28, transfer arm tubing 43, transfer arm cylinder 44, transfer arm lift cylinder 45, transfer arm fork 46, and transfer arm roller 47.

Figure 11:
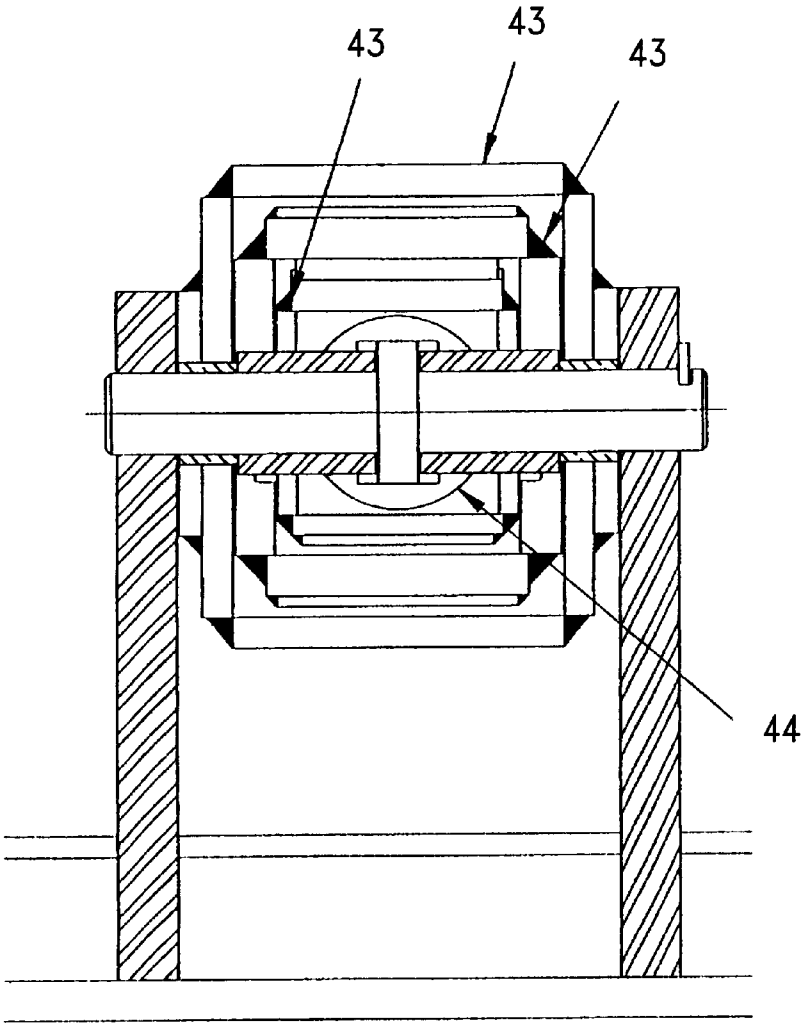
FIG. 11 is a cross section view along line A—A of FIG. 10 of the present invention.

FIG. 11 is a cross section view along line A—A of FIG. 10 and further illustrates transfer arm tubing 43, transfer arm cylinder 44.

Figure 12:
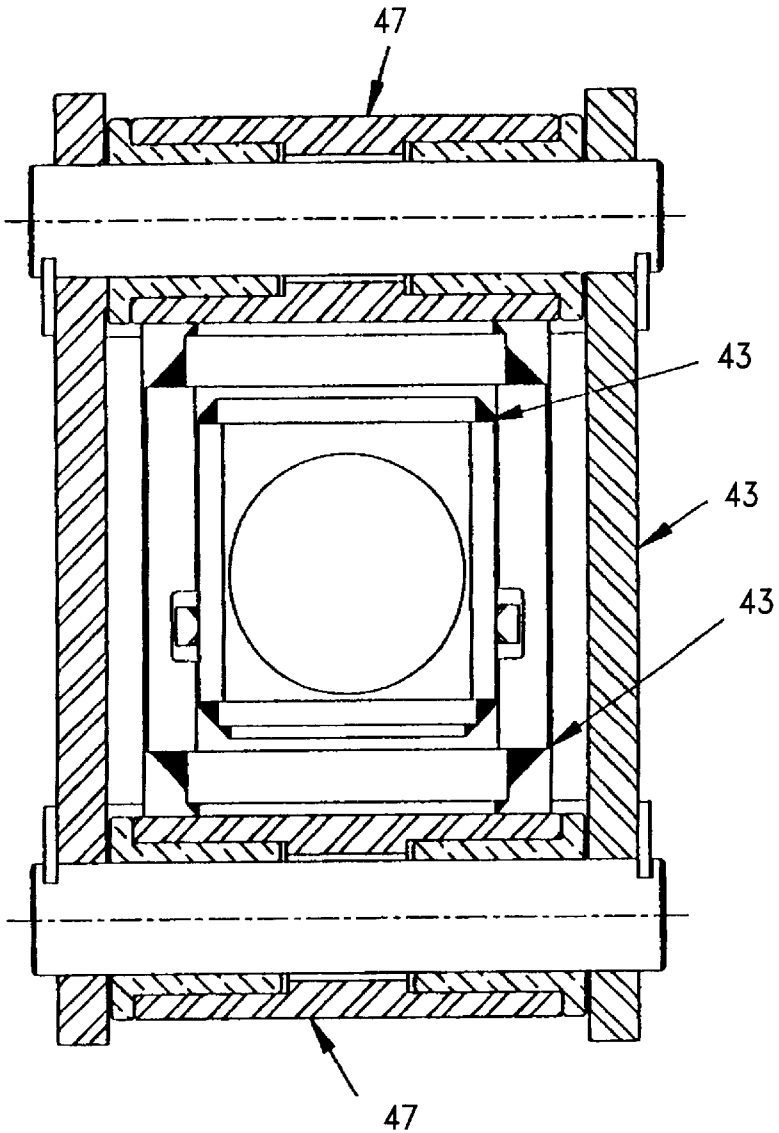
FIG. 12 is a cross section view along line B—B of FIG. 10 of the present invention.

FIG. 12 is a cross section view along line B—B of FIG. 10 and further illustrates transfer arm tubing 43 and transfer arm roller 47.

Figure 13:
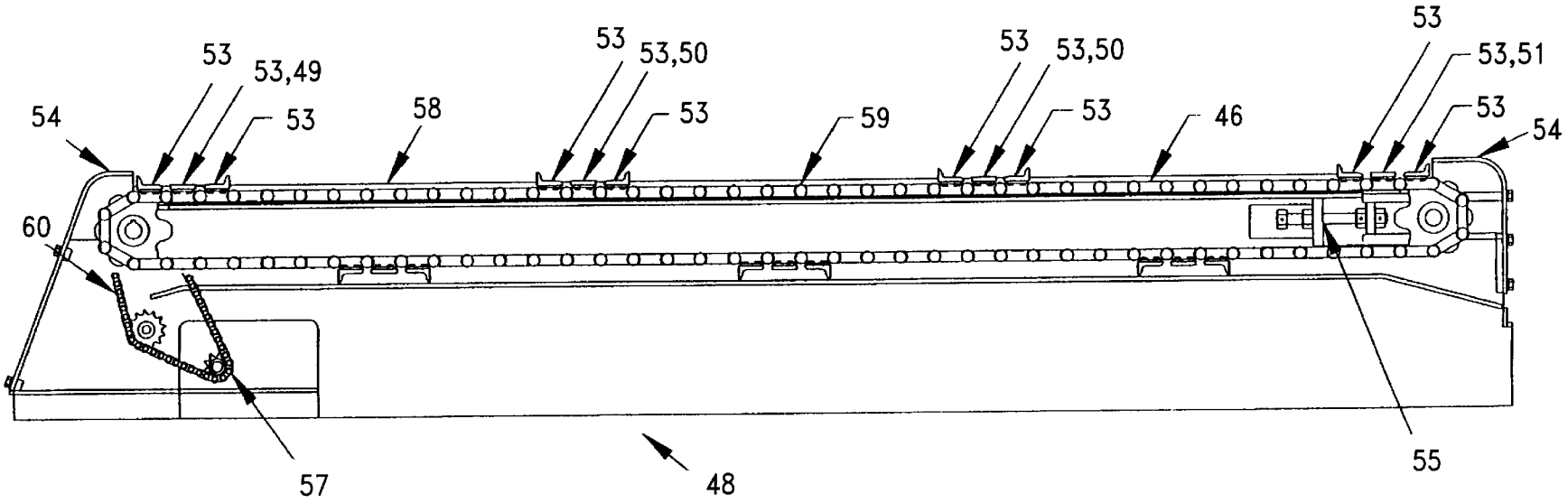
FIG. 13 is an elevation view of the auger staging rack of the present invention.

FIG. 13 is an elevation view of the retrieval unit auger staging rack 48 and further illustrates the transfer arm fork 46, retrieval unit staging rack loading area 49, retrieval unit staging storage area 50, retrieval unit staging rack staging area 51, staging chain attachment 53, auger staging stop 54, staging chain takeup 55, drive cross shaft sprocket 57, staging rack side guide 58, staging chain rollers 59 and staging drive chain 60.

Figure 14:
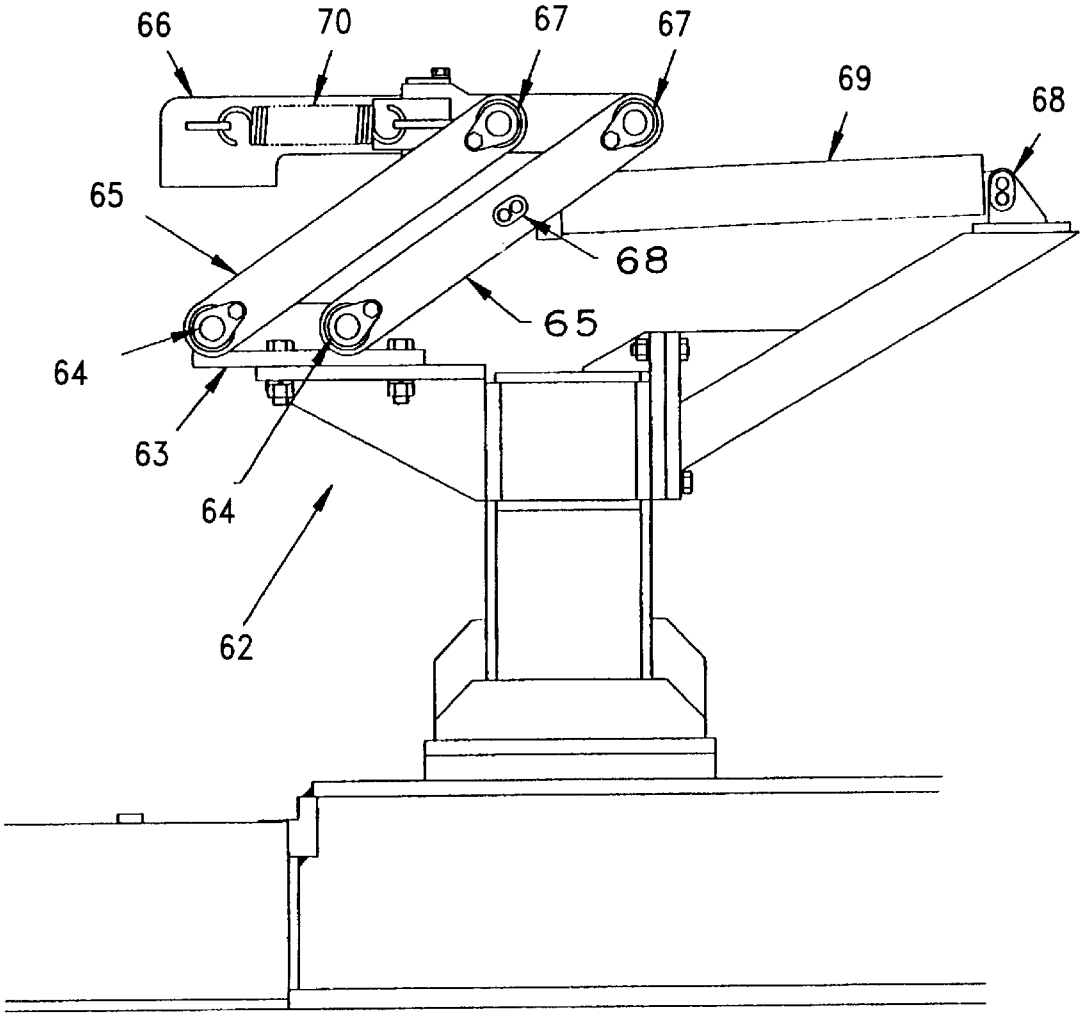
FIG. 14 is an elevation view of the front delatch mechanism of the present invention.

FIG. 14 is an elevation view of front delatch mechanism 62 and further illustrates delatch plate 63, delatch plate clevis 64, delatch linkage 65, delatch arm 66, delatch arm clevis 67, delatch pin 68 and delatch cylinder 69 and delatch spring 70.

Figure 15:
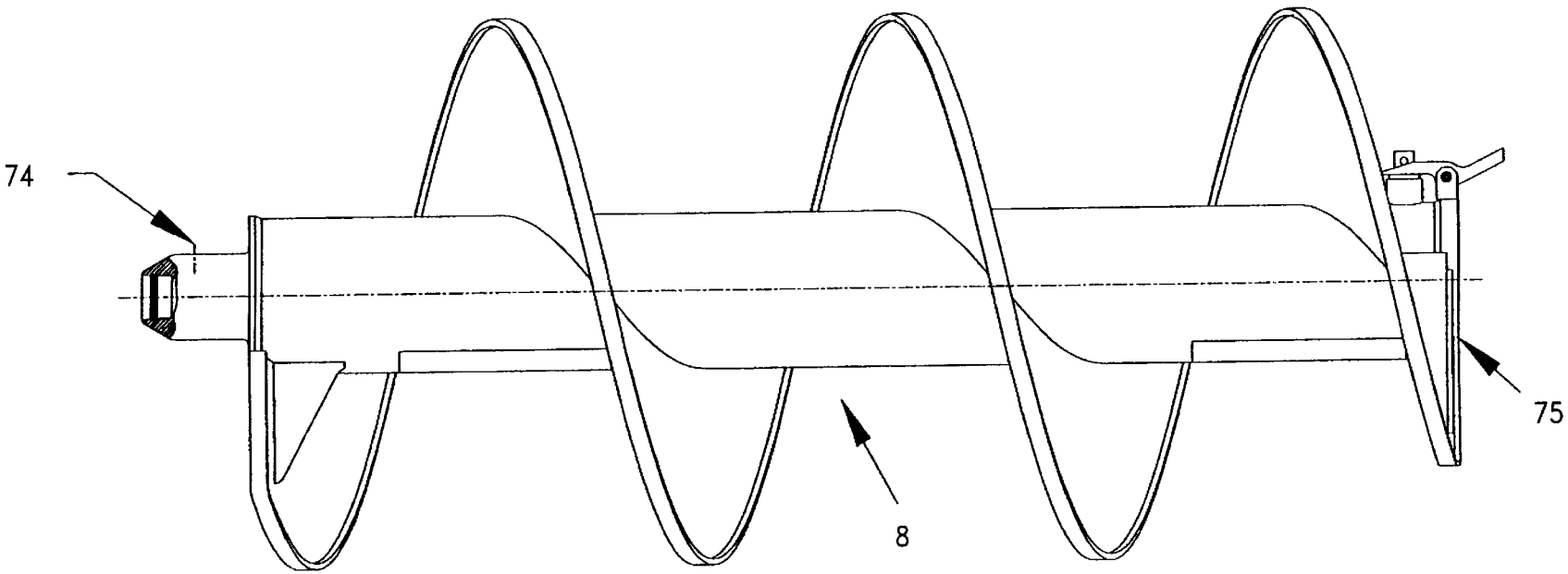
FIG. 15 is an elevation view of an auger flight of the present invention.

FIG. 15 is an elevation view of an auger flight 8 and further illustrates auger shank 74 and auger socket 75.

Figure 16:
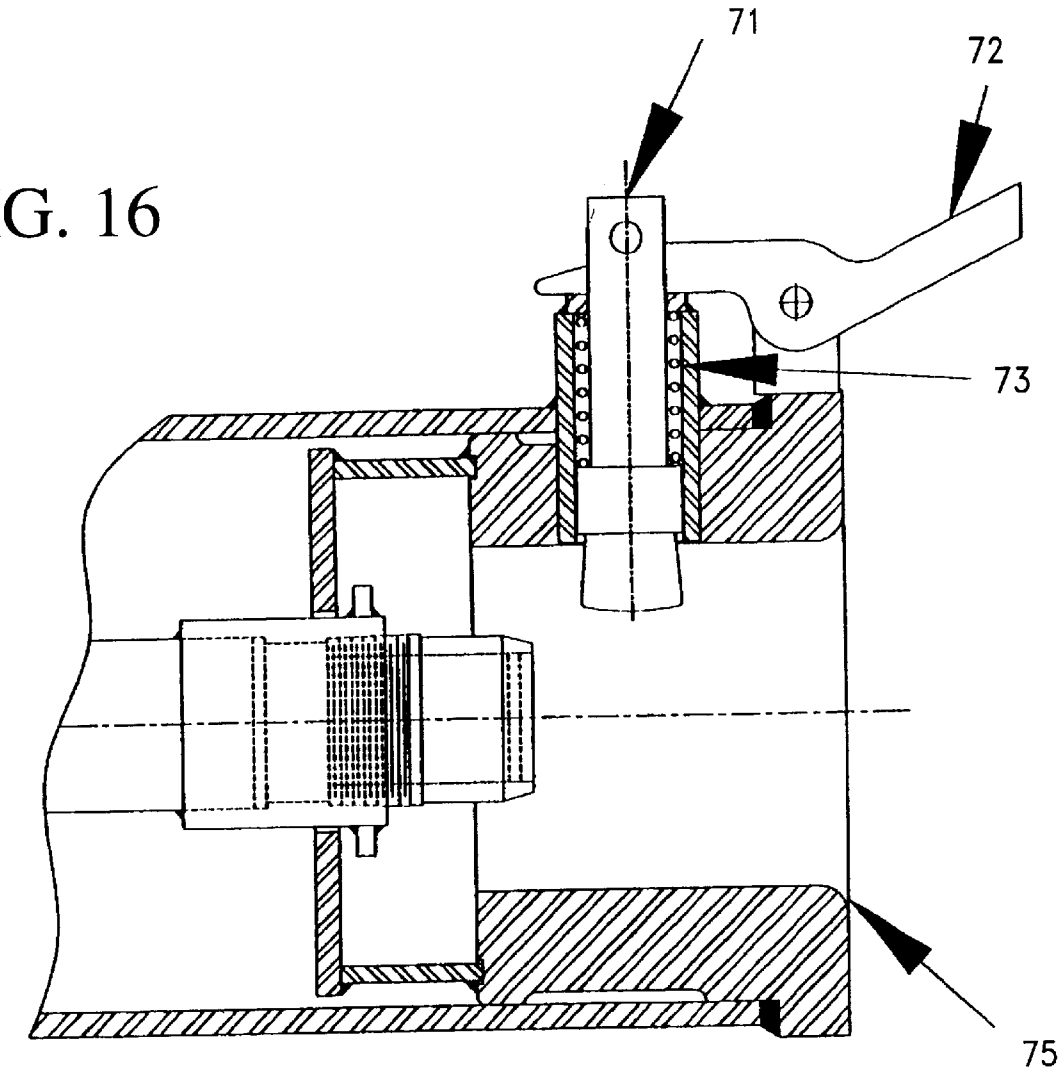
FIG. 16 is a section view of an auger flight socket.

FIG. 16 is a section view of an auger flight socket 75 and further illustrates an auger flight pin 71, an auger latch lever 72, and an auger latch spring 73.

DESCRIPTION OF THE PREFERRED EMBODIMENT

Referring to FIGS. 1 through 16, the preferred embodiment of the present invention comprises a drill unit disposed with a drive, a frame, a carriage moveable on the frame, a propulsion unit with drive chuck and means on said frame and carriage for rotating a cutting head driven by a string of auger flights, a crowd mechanism to move the carriage on the frame and advance the cutting head driven by a string of auger flights for drilling a parallel horizontal hole, a front delatch mechanism disposed on the drill unit to engage the latch pin lever of an auger flight to disengage the auger flight from the string of auger flights in the drilled horizontal parallel hole, a belly pan disposed in the drill unit and adapted to cooperate with a transfer arm and to accept and receive auger flights for the connection and addition of the auger flights to the string of auger flights, leveling jacks, skids and roof jacks disposed on the drill unit to facilitate moving and stabilizing the unit and setting the angle for drilling the horizontal parallel hole, a conveyor means disposed at the operation end of the drill unit to remove the mined substance away from the drill unit, and an activating means to actuate the drill unit. Preferably, the propulsion unit is a Mannesmann Rexroth motor (an hydraulic fixed displacement motor) using petroleum based fluid at high pressure to generate the rotation and torque input necessary for drilling of the hole. The crowd mechanism preferably comprises four chains attached at one end to the frame of the drill unit each of which transverse a sprocket and at the other end of each chain disposed to attach to threaded adjusters on the carriage with the sprockets adapted to slideably accept each of the chains and sprocket boxes disposed between the sprockets and threaded adjusters and with a cylinder to move the sprocket box within guide bars on the frame to move the carriage on the frame of the drill unit toward or away from a drilled hole. Preferably four cylinders, four chains, and four sprocket boxes are provided with two of the cylinders to provide the thrust or forward force on the carriage and two of the cylinders to provide the pull or reverse force on the carriage. Preferable activating means to activate the movement of the crowd mechanism are hydraulic joysticks. Preferably the front delatch mechanism comprises a plate, with devices adapted to pivotally accept a linkage where the linkage has two ends adapted to attach to and pivot on the devices at the plate on one end and attach to and pivot on a delatch arm disposed at the other end with a delatch arm with a plurality of devices at one end and adapted to attach to the linkage and the other end adapted to engage the latch lever of the auger flight to disconnect the auger flight from the string of auger flights and pins to secure the linkage to the devices with an hydraulic cylinder and activating means disposed between the frame of the linkage to move the delatch arm toward and away from the latch lever of the auger flight and a spring disposed between the linkage and the delatch arm adapted to prevent the delatch arm from transferring actual loads to the linkage. The preferred activating means for the delatch mechanism are hydraulic joysticks.

Further, a retrieval unit comprising a drive, a frame, a moveable carriage on the frame, a propulsion unit with drive chuck and means on said frame and carriage for rotating a cutting head driven by a string of auger flights from a drilled parallel horizontal hole, a crowd mechanism to move the carriage on the frame and remove the cutting head driven by the string of auger flights from the parallel horizontal drilled hole, a front delatch mechanism disposed on said retrieval unit to engage the latch pin lever of an auger flight to disengage the auger flight from the string of auger flights in the drilled horizontal parallel hole, a belly pan disposed on the retrieval unit adapted to cooperate with a transfer arm and a transfer arm mechanism to move auger flights to and from a belly pan disposed on the retrieval unit to the belly pan disposed on the drill unit or to and from an auger staging rack disposed on the retrieval unit, an auger staging rack disposed to accept loading, storage, and unloading of auger flights and adapted to cooperate with the transfer arm mechanism to transfer auger flights and leveling jacks, skids, and roof jacks disposed on the retrieval unit to facilitate moving and stabilizing the retrieval unit and adjusting the angle for extracting flights from a string of auger flights in the drilled parallel horizontal hole; and an activating means to activate the retrieval unit. Preferably, the propulsion unit is a Mannesmann Rexroth motor using petroleum based fluid at high pressure to generate the rotation and torque input necessary for the removal of the string of auger flights from the parallel drilled hole. The crowd mechanism preferably comprises four chains attached at one end to the frame of the retrieval unit each of which transverse a sprocket and at the other end of each chain disposed to attach to threaded adjusters on the carriage with the sprockets adapted to slideably accept each of the chains and sprocket boxes disposed between the sprockets and thread adjusters and with a cylinder to move the sprocket box within guide bars on the frame to move the carriage on the frame of the retrieval unit toward or away from a drilled hole. Preferably four cylinders, four chains, and four sprocket boxes are provided with two of the cylinders to provide the thrust or forward force on the carriage and two of the cylinders to provide the pull or reverse force on the carriage. Preferable activating means to activate the movement of the crowd mechanism are hydraulic joysticks. Preferably the front delatch mechanism comprises a plate, with devices adapted to pivotally accept a linkage where the linkage has two ends adapted to attach to and pivot on the devices at the plate on one end and attach to and pivot on a delatch arm disposed at the other end with a delatch arm with a plurality of devices at one end and adapted to attach to the linkage and the other end adapted to engage the latch lever of the auger flight to disconnect the auger flight from the string of auger flights and pins to secure the linkage to the devices with an hydraulic cylinder and activating means disposed between the frame of the linkage to move the delatch arm toward and away from the latch lever of the auger flight and a spring disposed between the linkage and the delatch arm adapted to prevent the delatch arm from transferring actual loads to the linkage. The preferred activating means for the delatch mechanism is an hydraulic joystick.

The transfer arm mechanism disposed in the retrieval unit preferably comprises an arm with a fixed end and a telescoping end with a plurality of tubes and the fixed end with pivotally attached to the frame of the retrieval unit and adapted to point up and down from the frame with tubes adapted to slide within each other and telescope in and out of the arm to the belly pan of the drill unit or to the belly pan of the retrieval unit or to the staging rack of the retrieval unit. A double acting cylinder disposed in the arm extends and retracts the tubing in and out of the arm and is activated preferably by hydraulic joystick and a second double acting lift cylinder preferably with hydraulic joystick to activate the second double acting lift cylinder is disposed between the frame of the retrieval unit and the arm and raises and lowers the arm and a fork is disposed at the telescoping end of the arm and is adapted to pick up and receive auger flights for the movement of the flights.

A staging rack is disposed in the retrieval unit and comprises a loading area adapted to accept the loading and unloading of auger flights in the retrieval unit, a storage area to accept and store a plurality of auger flights, a staging area to receive auger flights from the loading area, storage area and the belly pan of the drill unit all of which cooperate with the transfer arm mechanism for the transfer of auger flights and the staging rack comprises preferably two staging chains connected end to end forming loops with two ends and disposed within and transversing the loading area, storage area, and staging area and adapted to transfer auger flights to and from the loading area, storage area, and staging area in an operation synchronized to provide even movement of the auger flights during transfer. Preferably a plurality of staging chains attachments are disposed on the staging chains to secure and position the auger flights in transfer and stops are provided and disposed at each end of the staging chain loop and encompass the staging chains to position the auger flights in the staging area, loading area and storage area to prevent the auger flights from rolling off of the retrieval unit. Staging chain take-ups are disposed on each chain and adjust slack in the chains and a drive cross shaft with sprockets preferably disposed between the frame of the retrieval unit and staging chains at each end of the staging chain loop and adapted to cooperate with and move the staging chains and with side guards disposed on the frame to cooperate with and guide and align the staging chains on the retrieval unit. Preferably the staging chains have rollers at each link of the staging chains provided to roll during the movement of the staging chains and reduce resistance and prevent sliding of the staging chains. The preferable chain is an U.S. Tsubaki conveying and elevating chain. Further, and preferably a drive chain connected end to end and disposed between the power source and the drive cross shaft rotates and drives the cross shaft to move the staging chains. Preferably the power source are low speed hi-torque hydraulic motors and the activating means to activate the auger staging rack preferably is an hydraulic joystick.

Interchangeable connecting links provided and disposed between the drill unit and retrieval unit preferably are removable and generally dogbone in shape bars which are adapted to pivotally connect the drill unit and retrieval unit by pins extending through the frame of each unit and the dogbone ends of the bars which reduces the stress reduced in each unit's frame in the event of uneven alignment. The dogbone connectors are interchangeable to allow adjustments to pillar widths and assure the drive chains of the drill unit and retrieval unit are parallel during operation. Preferably one interchangeable connecting link is provided in front and one interchangeable connecting link is provided in the back connecting the fronts and backs of the drill unit and retrieval unit accordingly.

Although the invention has been described in preferred form with a certain degree of particularity, it is understood that the present disclosure of the preferred form has been made only by way of example and numerous changes in the detail of construction and the combination arrangement of the parts may be resorted to without departing from the spirit and scope of the invention as hereinafter claimed.

What is claimed is:

1. In an underground mine augering apparatus where a series of relatively deep parallel horizontal holes are drilled and when the drilling of one hole is completed the apparatus is moved over the mine floor to a next adjacent position for drilling an adjacent parallel hole, and a string of auger flights in the drilled hole is detached from the apparatus until needed prior to the shifting of the apparatus to its new drilling position, and the auger flights are transferred one at a time for connection to the drill string during drilling of the adjacent hole wherein the improvement is an underground auger system and comprises:

a drill unit disposed with a drive, a frame, a carriage moveable on the frame, a propulsion unit with drive chuck and means on said frame and carriage for rotating a cutting head driven by a string of auger flights, a crowd mechanism to move the carriage on the frame and advance the cutting head driven by a string of auger flights for drilling a parallel horizontal hole, a front delatch mechanism disposed on said drill unit to engage the latch pin lever of an auger flight to disengage the auger flight from the string of auger flights in the drilled horizontal parallel hole, a belly pan disposed in the drill unit adapted to cooperate with a transfer arm and to accept and receive auger flights for the connection and addition of the auger flights to the string of auger flights, leveling jacks, skids and roof jacks disposed on the drill unit to facilitate moving and stabilizing the unit and setting the angle for drilling the horizontal parallel hole, a conveyor means disposed at the operation end of the drill unit to remove the mined substance away from the drill unit; and activating means to actuate the drill unit;

a retrieval unit disposed with a drive, a frame, a moveable carriage on the frame, a propulsion unit with drive chuck and means on said frame and carriage for rotating a cutting head driven by a string of auger flights from a drilled parallel horizontal hole, a crowd mechanism to move the carriage on the frame and remove the cutting head driven by the string of auger flights from the parallel horizontal drilled hole, a front delatch mechanism disposed on said retrieval unit to engage the latch pin lever of an auger flight to disengage the auger flight from the string of auger flights in the drilled horizontal parallel hole, a belly pan disposed on the retrieval unit adapted to cooperate with a transfer arm, a transfer arm mechanism to move auger flights to and from a belly pan disposed on the retrieval unit to the belly pan disposed on the drill unit or to and from an auger staging rack disposed on the retrieval unit, an auger staging rack, disposed to accept loading, storage, and unloading of auger flights and adapted to cooperate with the transfer arm mechanism to transfer auger flights, leveling jacks, skids, and roofjacks disposed on the retrieval unit to facilitate moving and stabilizing the retrieval unit and adjusting the angle for extracting flights from a string of auger flights in the drilled parallel horizontal hole; and activating means to activate the retrieval unit;

interchangeable connecting links disposed between the drive end of the drill unit and the drive end of the retrieval unit and disposed between the operation end of the drill unit and the operation end of the retrieval unit to provide consistent widths between the center to center distance of the parallel horizontal drilled holes and adapted to adjust and change the center to center distance of said holes and to reduce stress in the event that either the drill unit or the retrieval unit are raised in an uneven manner, and to couple the drill unit and retrieval unit to provide for the simultaneous drilling of an additional parallel horizontal hole by the drill unit and the simultaneous retrieval of the auger flights from the string of auger flights by the retrieval unit from a previously drilled parallel horizontal hole.

2. The underground auger system of claim 1 wherein the crowd mechanism of the drill unit comprises a plurality of chains each disposed to attach at one end to the frame of the drill unit and adapted to transverse a sprocket and the other end disposed to attach to thread adjusters on the carriage, sprockets adapted to slideably accept each of the chains, sprocket boxes disposed between the sprockets and a plurality of cylinders and adapted to slideably move within guide bars disposed in the frame on each side of each sprocket box, guide bars disposed in to the frame of the drill unit and adapted to slideably accept the sprocket boxes within, a plurality of cylinders with activating means adapted to move the sprocket boxes within the guide bars and move the carriage on the frame of the drill unit toward or away from the drilled hole, activating means to activate the cylinders, and thread adjusters attached to one end of each chain and to the carriage to provide for even pull on the carriage and adjustment for chain wear.

3. The underground auger system of claim 2 wherein the number of chains is four.

4. The underground auger system of claim 1 wherein the crowd mechanism of the retrieval unit comprises a plurality of chains each disposed to attach at one end to the frame of the retrieval unit and adapted to transverse a sprocket and the other end disposed to attach to thread adjusters on the carriage, sprockets adapted to slideably accept each of the chains, sprocket boxes disposed between the sprockets and a plurality of cylinders and adapted to slideably move within guide bars disposed in the frame on each side of each sprockets box, guide bars disposed in the frame of the retrieval unit and adapted to slideably accept the sprocket boxes within, a plurality of cylinders with activating means adapted to move the sprocket boxes within the guide bars and move the carriage on the frame of the retrieval unit toward or away from the drilled hole, activating means to activate the cylinders, and thread adjusters attached to one end of each chain and to the carriage to provide for even pull on the carriage and adjustment for chain wear.

5. The underground auger system of claim 4 wherein the number of chains is four.

6. The underground auger system of claim 1 wherein the front delatch mechanism disposed on the drill unit and retrieval unit comprises a plate with a plurality of devices and adapted to pivotally accept a plurality of linkage, linkage with two ends adapted to attach to and pivot on the clevices of the plate at one end and to attach to and pivot on a delatch arm disposed at the other end, a delatch arm with two ends disposed with a plurality of devices at one end and adapted to attach to the linkage and the other end adapted to engage the latch lever of an auger flight to disconnect the auger flight from the string of augers, a plurality of pins to secure the linkage to the clevices, a cylinder with activating means disposed between the frame and the linkage to move the delatch arm toward and away from the latch lever of the auger flight, activating means to activate the cylinder, and a spring disposed between the linkage and delatch arm adapted to prevent the delatch arm from transferring axial loads to the linkage.

7. The underground auger system of claim 6 wherein the number of staging chains is two.

8. The underground auger system of claim 1 wherein the transfer arm mechanism disposed in the retrieval unit comprises an arm with a fixed end and a telescoping end with a plurality of tubes within and pivotally attached at the fixed end to the frame of the retrieval unit and adapted to point up and down from the frame, a plurality of tubes adapted to slide within each other and telescope in and out of the arm to the belly pan of the drill unit or to the belly pan of the retrieval unit or to the staging rack on the retrieval unit, a double acting cylinder disposed in the arm and adapted to extend and retract the tubing in and out of the arm, activating means to activate the cylinder, a second double acting lift cylinder with activating means disposed between the frame of the retrieval unit and the arm and adapted to raise and lower the arm, activating means to activate the lift cylinder, and a fork disposed at the telescoping end of the arm and adapted to pick up and receive auger flights for movement of the flights.

9. The underground auger system of claim 1 wherein the staging rack disposed in the retrieval unit comprises a loading area adapted to accept the loading and unloading of auger flights in the retrieval unit, a storage area adapted to accept and store a plurality of auger flights, a staging area adapted to receive auger flights from the loading area, storage area and the belly pan of the drill unit, all adapted to cooperate with the transfer arm mechanism for the transfer of auger flights, a plurality of staging chains connected end to end forming loops with two ends and disposed within and transversing the loading area, storage area, and staging area and adapted to transfer auger flights to and from the loading area, storage area, and staging area and in operation synchronized to provide even movement of the auger flights during transfer, a plurality of staging chain attachments disposed on the staging chains to secure and position the auger flights in transfer, a plurality of auger staging stops disposed at each end of each staging chain loop and encompassing the staging chains and adapted to position the auger flights in the staging area, loading area, and storage area and adapted to prevent the auger flights from rolling off of the retrieval unit, staging chain take-ups disposed on each chain and adapted to adjust slack in the staging chains, a drive cross shaft with sprockets disposed between the frame of the retrieval unit and staging chains at each end of each staging chain loop and adapted to cooperate with and move the staging chains, a plurality of side guides disposed on the frame adapted to cooperate with and guide and align the staging chains on the retrieval unit, a plurality of rollers of larger diameter than the staging chains disposed at each link of the staging chains disposed at each link of the staging chains adapted to roll during movement of the staging chains to reduce resistance and to prevent sliding of the staging chains, a drive chain connected end to end and disposed between a power source and drive cross shaft and adapted to cooperate with and rotate the drive cross shaft to move the staging chains, a power source adapted to drive each drive chain, and an activating means to activate the auger staging rack.

10. The underground auger system of claim 1 wherein the interchangeable connecting links disposed between the drill unit and retrieval unit are removable bars and generally dogbone in shape and are adapted to pivotally connect to the drill unit and retrieval unit by pins extending through the frame of each unit and the dogbone ends of the bars, pins adapted to extend through the frames of the drill unit and retrieval unit and the dogbone ends of the bars, and caps adapted to cooperate with the pins to secure the bars to the drill unit and retrieval unit and allow rotation of the bars on the pins.

* * * * *